United States Patent [19]

McGowan

[11] 4,166,294

[45] Sep. 4, 1979

[54] BATHTUB SHROUD

[76] Inventor: Malissa McGowan, 1502 E. 126th St., Compton, Calif. 90222

[21] Appl. No.: 898,676

[22] Filed: Apr. 21, 1978

[51] Int. Cl.[2] ..... A61H 33/12; A61H 33/06

[52] U.S. Cl. ..... 4/162; 4/160

[58] Field of Search ..... 4/162, 161, 159, 157, 4/164, 160

[56] References Cited

U.S. PATENT DOCUMENTS

| | | | |
|---|---|---|---|
| 2,243,505 | 5/1941 | Mercer | 4/159 |
| 2,541,029 | 2/1951 | Burton | 4/162 |
| 3,119,122 | 1/1964 | Weisbeck | 4/162 |
| 3,375,534 | 4/1968 | Vieceli | 4/162 |
| 3,611,448 | 10/1971 | Dudley | 4/162 |
| 3,837,014 | 9/1974 | Sugiyama | 4/162 |
| 3,961,380 | 6/1976 | Garr | 4/162 |
| 4,014,054 | 3/1977 | Pasquarello | 4/159 |

*Primary Examiner*—Henry K. Artis
*Attorney, Agent, or Firm*—Louis J. Bachand

[57] ABSTRACT

Bathtub shroud for retaining bath water heat about a person bathing, comprising a generally rectangular thermally insulative, water impervious sheet material defining a shroud sized to overfit the tub opening, and fastening means distributively arranged to secure the shroud in tub water-covering relation, and collar means adapted to maintain the shroud about the neck of the bather.

2 Claims, 6 Drawing Figures

BATHTUB SHROUD

BACKGROUND OF THE INVENTION

This invention has to do with expedients for assisting tub bathers in retaining tub water heat about the body during prolonged periods of bathing, for therapy purposes, for example. More particularly the invention is concerned with a shroud which overfits the wearer and is securable to the tub wall by suction or magnetic means for purposes of forming a tent in which bath tub, water heat may be retained during prolonged bathing periods.

Long soaking baths are frequently recommended for physical therapy purposes. The conventional home tub however, is open to the surrounding atmosphere and loses heat quickly. Physical therapy bathing generally requires a far longer period of soaking in comforting heat than is permitted by the heat retention characteristics of bath water. Therefore, unless the user continually runs fresh hot water into the tub, an expensive and energy wasteful practice, the tub water too soon becomes non-therapeutically cool and uncomfortable.

SUMMARY OF THE INVENTION

It is therefore an object of the present invention to provide means for retaining bath water heat for a period sufficient to enable e.g., physical therapy soaking of the body in a conventional home tub. It is a further object of the invention to provide a tub opening covering device which may be secured to the tub in bather overfitting relation to enclose the tub opening to thereby retain better tub water heat in and around the bather. It is a further objective of the present invention to provide a shroud for a tub bather which is interfitted with the bather's neck, and otherwise perimetrically secured to the tub walls so as to cover the normal tub opening in heat retaining relation.

These and other objects of the invention to become apparent hereinafter are realized in accordance with the invention in a bathtub shroud for retaining bath water heat about a person bathing comprising a generally rectangular thermally insulative, water impervious sheet material defining a shroud sized to overfit the tub opening, fastening means arranged on the shroud longitudinal edges to secure the edges to the opposing longitudinal tub wall beyond the tub opening in tub water covering relation, and collar means formed at the shroud lateral edge, the collar means including diametrically adjustable member to adjustably closely fit the bather's neck for bath water heat retention about the bather's body.

In one particular embodiment the bathtub shroud adjustable collar member is formed of generally U-shaped spring steel, and the shroud defines a receiving pocket therefor normally encircling the neck of the bather in the work condition of the shroud. In another particular embodiment the collar member comprises overlapping padded tabs which extend around the bather's neck.

The fastening means may comprise a series of suction adhesive pads adapted to grip the tub walls in shroud position securing relation, e.g. said fastening may be distributed perimetrically of the shroud. Alternatively the fastening means may comprise a series of discrete magnets, similarly located, adapted to grip the tub walls in shroud position securing relation.

The shroud sheet material may comprise a water impervious and thermally insulative organic polymer. In some embodiments the bathtub shroud may further include magnetic or suction adherent means distributed along the lateral edge of the shroud opposite the collar member heretofore mentioned.

IN THE DRAWINGS

The invention will be further described as to an illustrative embodiment in conjunction with the attached drawings in which.

DESCRIPTION OF THE PREFERRED EMBODIMENTS

Figure 1:
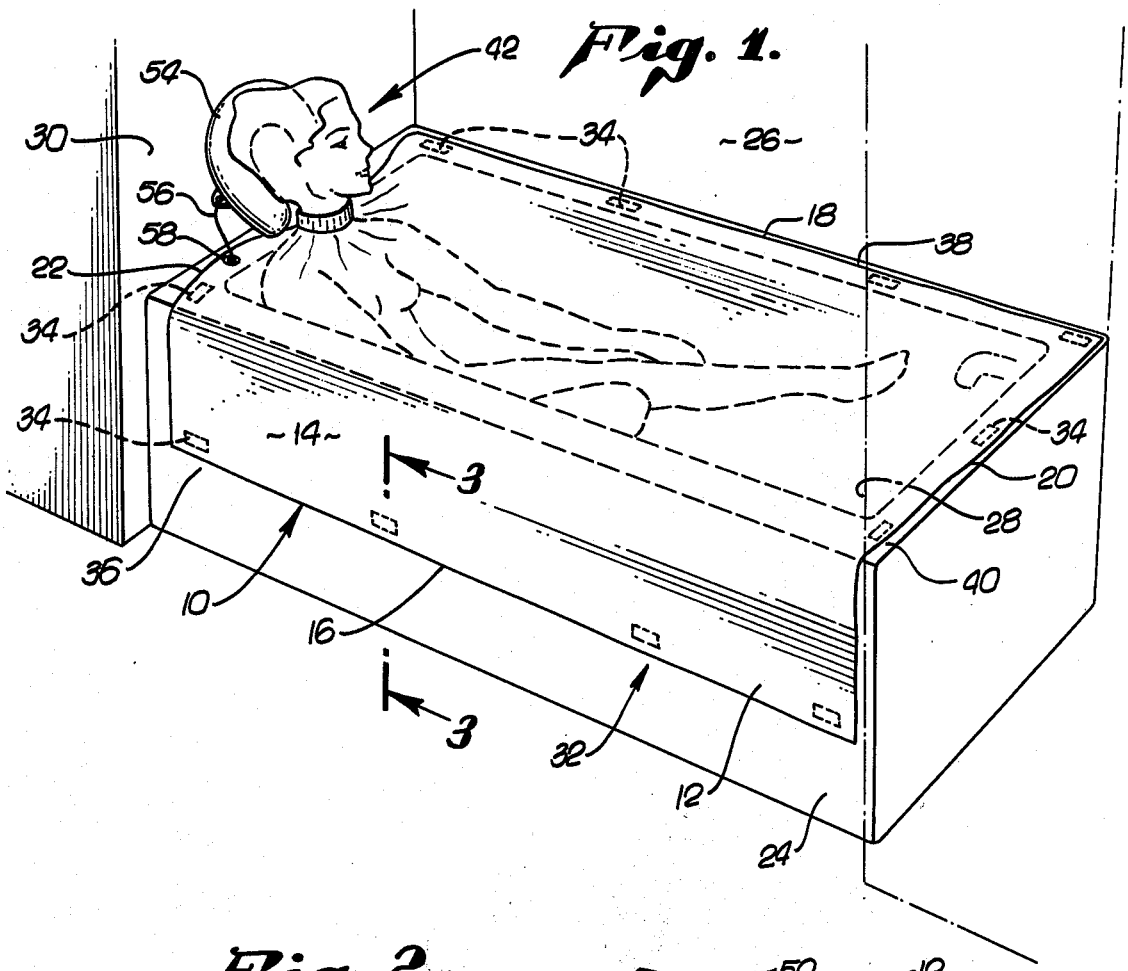
FIG. 1 is a perspective view of the tub shroud according to the present invention.

With reference now to the drawings in detail the tub shroud according to the invention is depicted in the worn condition in FIG. 1. Thus shroud 10 is there shown to comprise a sheet 12 of moisture impervious and thermally insulative e.g. synthetic organic plastic material 14 having first and second longitudinal edges 16, 18 respectively and first and second transverse edges 20, 22 respectively.

The shroud 10 is shown draped over a conventional bathtub 24 formed of cast iron and having a porcelain finish. The bathtub 24 is positioned along room wall 26 and between end walls 28, 30 in the typical, illustrative situation.

Figure 3:
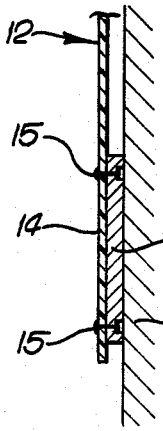
FIG. 3 is a section taken on line 3—3 in FIG. 1.

As best shown in FIG. 1, the shroud 10 is provided along its perimeter 32 with a series of fasteners 34. With particular attention to FIG. 3, the fasteners 34 are seen to be metallic elements of magnetic quality themselves fastened to plastic material 14 with rivets 15 which removably secure themselves to the tub wall portion 36 thereopposite. One series of four fasteners 34 are provided along the first or outer longitudinal shroud edge 16 and a second series of four is provided along the second, or inner longitudinal shroud edge 18. A third series of fasteners, just two in number, is provided along the transverse shroud edge 20.

The just mentioned fasteners magnetically adhere to the tub wall portions 36, 38 and 40 thereopposite and effectively hold the shroud 10 to the tub wall as shown.

Figure 4:
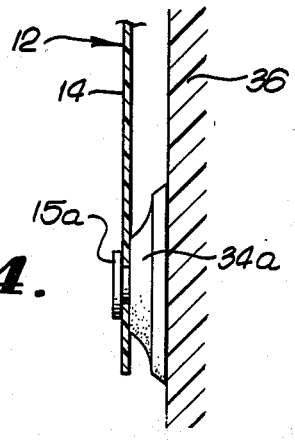
FIG. 4 is a view like FIG. 3 of an alternative form of the invention.

In an alternate embodiment shown in FIG. 4, a suction cup style of fastener **34*a* is shown received by button 15*a* to the shroud material 14**, for suction adherence of the shroud to the tub wall, particularly when the tub wall is formed of plastic.

Figure 2:
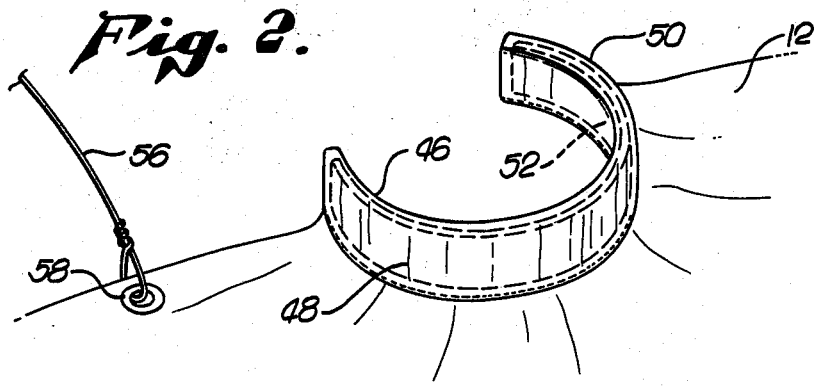
FIG. 2 is a fragmentary view also in perspective of the adjustable collar feature of the invention.

Special provision is made at the remaining transverse edge 22 to accommodate the bather 42. One fastener 34 is provided; the remainder of this edge is configured to define a neck opening 46, see FIG. 2, which is provided with extra material 48 shaped into a receiving pocket 50. A U-shaped member 52, e.g. of spring steel is fitted into the pocket 50 and there acts to draw the shroud edge 22 closely about the neck of bather 42.

A pillow 54 tethered by line 56 secured in grommet 58 is provided for additional user comfort, as shown.

Figure 5:
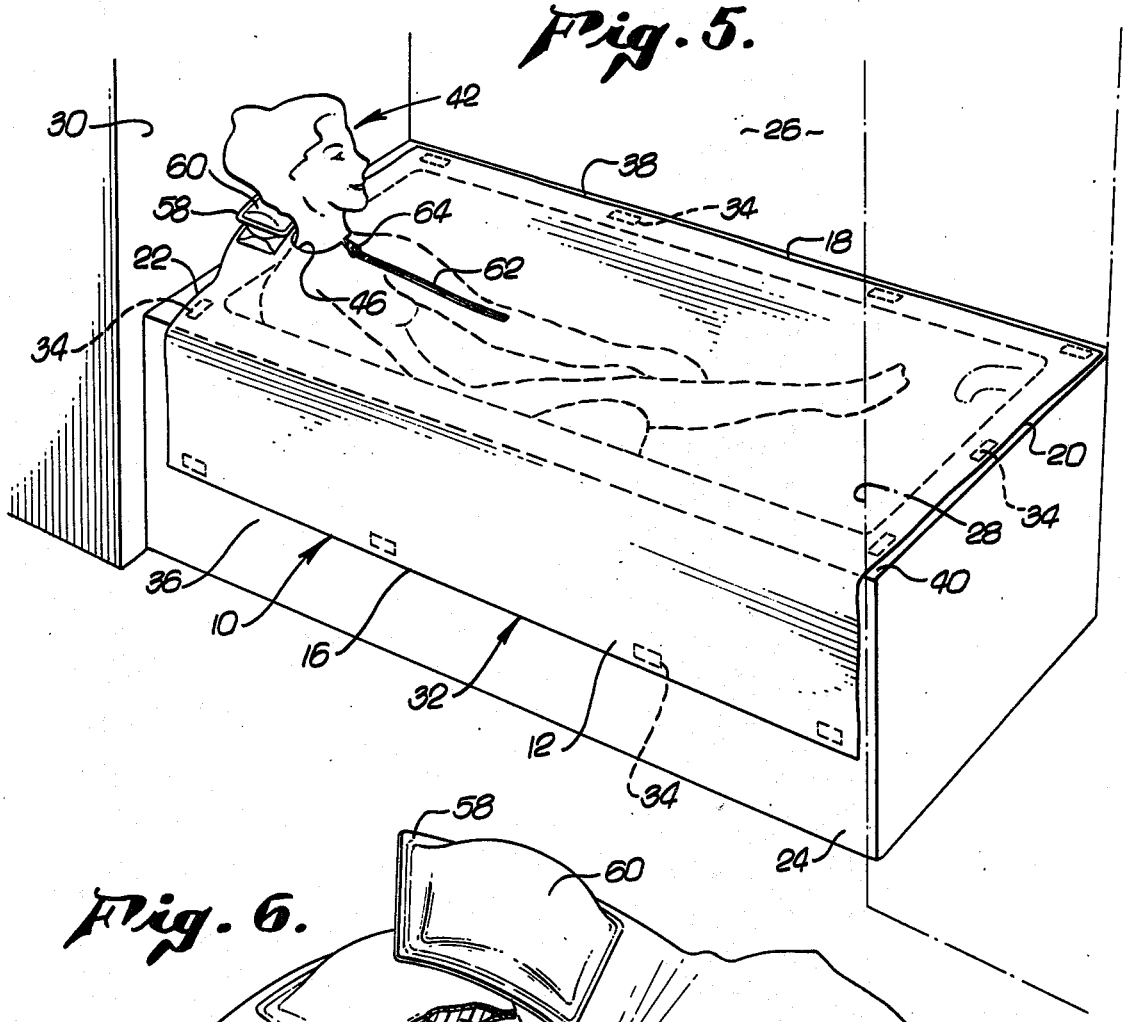
FIG. 5 is a view like FIG. 1 of an alternative embodiment of the invention.
Figure 6:
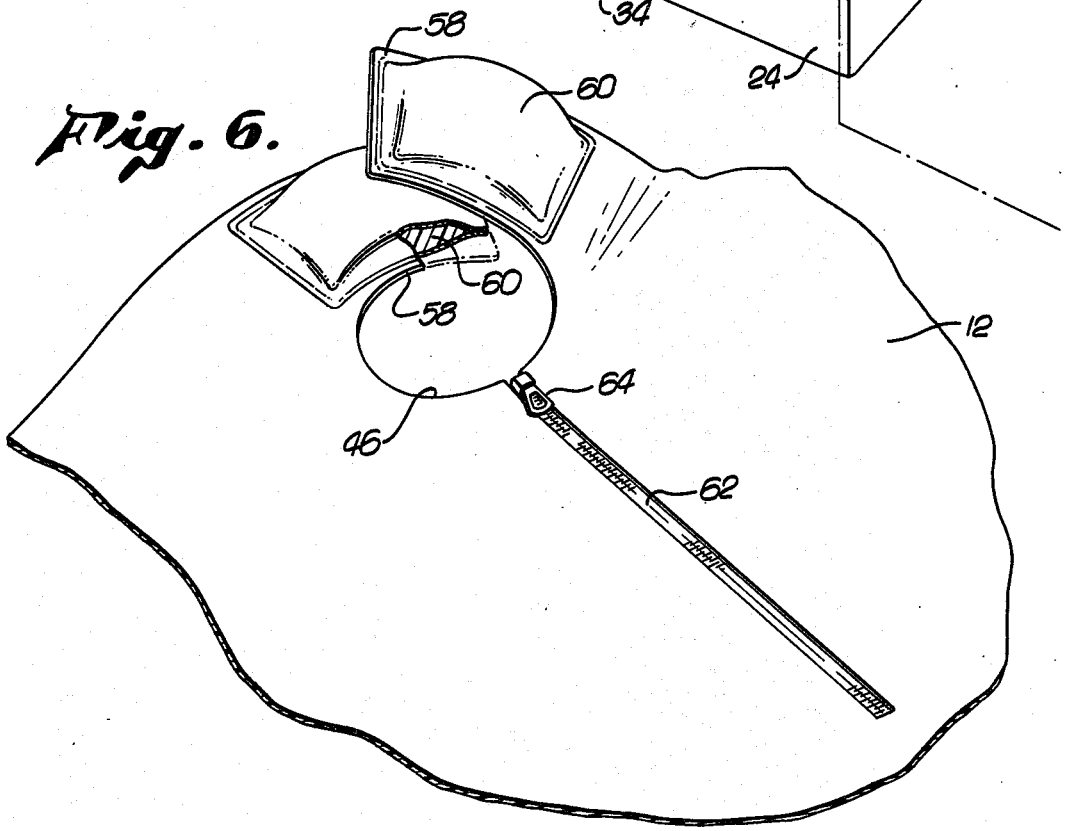
FIG. 6 is a fragmentary perspective view of an alternate form of collar member.

With reference to FIGS. 5 and 6, neck opening 46 is defined by opposed overlapping tabs 58 which are formed from continuations of sheet 12, bulked or padded to form pads 60 and sized relatively to overlapping in cushioning relation behind the head of the bather 42. A zipper 62 having slide 64 is provided to allow ease of donning the shroud and close-fitting thereof in the worn condition.

In use the tub 24 is filled with water and the bather 42 assumes a recumbent posture therein, guiding the shroud perimeter 32 into place against the tub walls while so doing. The magnetic fasteners 34 hold the shroud in place. Heat loss from the water is much reduced and the bather may remain comfortably in the tub for extended periods without need of continual replenishment of hot water.

I claim:

1. Bathtub shroud for retaining bath water heat about a person bathing, comprising a generally rectangular, thermally insulated, water impervious sheet material defining a shroud sized to overfit the tub opening in draped relation along one longitudinal edge of said tub, adherent fastening means distributively arranged on the shroud to self-adhere to the tub wall to perimetrically secure said shroud to the opposing tub walls beyond the tub opening in tub water covering relation, and collar means formed at one shroud lateral edge, said collar means being formed of a generally U-shaped spring steel member, said shroud defining a receiving pocket for said member normally encircling the neck of the bather in the worn condition of the shroud, for bath water heat retention about the bather's body.

2. Bathtub shroud for retaining bath water heat about a person bathing, comprising a generally rectangular, thermally insulated, water impervious sheet material defining a shroud sized to overfit the tub opening in draped relation along one longitudinal edge of said tub, adherent fastening means distributively arranged on the shroud to self-adhere to the tub wall to perimetrically secure said shroud to the opposing tub walls beyond the tub opening in tub water covering relation and collar means formed at one shroud lateral edge, said collar member comprising overlapping padded tabs which extend around the bather's neck, for bath water heat retention about the bather's body.

* * * * *